United States Patent [19]

Gorst

[11] Patent Number: 4,939,839

[45] Date of Patent: Jul. 10, 1990

[54] KNIFE WITH RETRACTABLE BLADE

[75] Inventor: Alan Gorst, Cheshire, United Kingdom

[73] Assignee: The Paramo Tools Group Ltd., Sheffield, United Kingdom

[21] Appl. No.: 411,540

[22] PCT Filed: Mar. 31, 1988

[86] PCT No.: PCT/GB88/00244

§ 371 Date: Nov. 1, 1989

§ 102(e) Date: Nov. 1, 1989

[87] PCT Pub. No.: WO88/07918

PCT Pub. Date: Oct. 20, 1988

[30] Foreign Application Priority Data

Apr. 4, 1987 [GB] United Kingdom ..... 8708112

[51] Int. Cl.[5] ..... B26B 3/00

[52] U.S. Cl. ..... 30/125; 30/162; 30/335

[58] Field of Search ..... 30/40, 125, 162, 163, 30/335, 336

[56] References Cited

U.S. PATENT DOCUMENTS

| | | | |
|---|---|---|---|
| 3,708,881 | 1/1973 | Bennett | 30/335 X |
| 3,927,473 | 12/1975 | Braginetz | 30/125 |
| 4,005,525 | 2/1977 | Gringer | 30/162 X |
| 4,068,375 | 1/1978 | Rathbun et al. | 30/125 |
| 4,604,805 | 8/1986 | Krieger | 30/125 X |

*Primary Examiner*—Douglas D. Watts

*Attorney, Agent, or Firm*—Salter & Michaelson

[57] ABSTRACT

A knife having pivotally connected handle parts and a blade mounted on a carrier. An actuator is manually operable to move the carrier to extend the blade from the handle and to retract the blade within the handle. The handle parts are held locked together while the blade or a part thereof is extended from the handle.

7 Claims, 2 Drawing Sheets

KNIFE WITH RETRACTABLE BLADE

This invention relates to a knife with a retractable blade, particularly but not exclusively to a knife incorporating a replaceable blade of the kind suited for use by carpet layers and other craftsmen.

Knives with retractable blades are known. Generally the handle of such a knife is made of two separable parts which together define a housing in which the blade can be retracted. In addition the handle provides for storage of replacement blades. In the known construction the handle parts can be separated to admit access to the interior irrespective of the disposition of the retractable blade. It is now recognised that serious accidents can occur if the handle parts should separate while the blade is extended and the knife is in use. The present invention has been made with this problem in mind.

According to the invention there is provided a knife comprising a handle formed in two handle portions, said handle portions being connected together by a pivot and being pivotally movable between an open position and a closed position, the handle portions in said closed position defining a housing, a retractable blade mounted on a blade carrier, the carrier being movable between a first position wherein the blade projects from the housing and a second position wherein the blade is retracted into the housing such that the blade is not substantially capable of further rearward movement characterised in that the two handle portions are locked in the closed position when the carrier is in the first position and are unlocked when the carrier is in the second position.

In a preferred embodiment of the invention the carrier is moved by an actuating member which is preferably manually operable. The carrier is movablele to one or more positions intermediate the first position and the second position wherein the blade is partially or wholly retracted within the housing, the handle parts remaining locked while said carrier is in an intermediate position. The actuating member is movable between a first position wherein movement of the carrier between the first position and an intermediate position is restrained and a second position wherein movement of the carrier between said first and intermediate positions is possible. The actuating member is further movable into a third position in order to move the carrier between its intermediate and second positions. Means are preferably provided for urging the actuating means into its first position.

A specific embodiment of the invention will now be described by way of example with reference to the accompanying drawings in which.

Figures 1, 2:
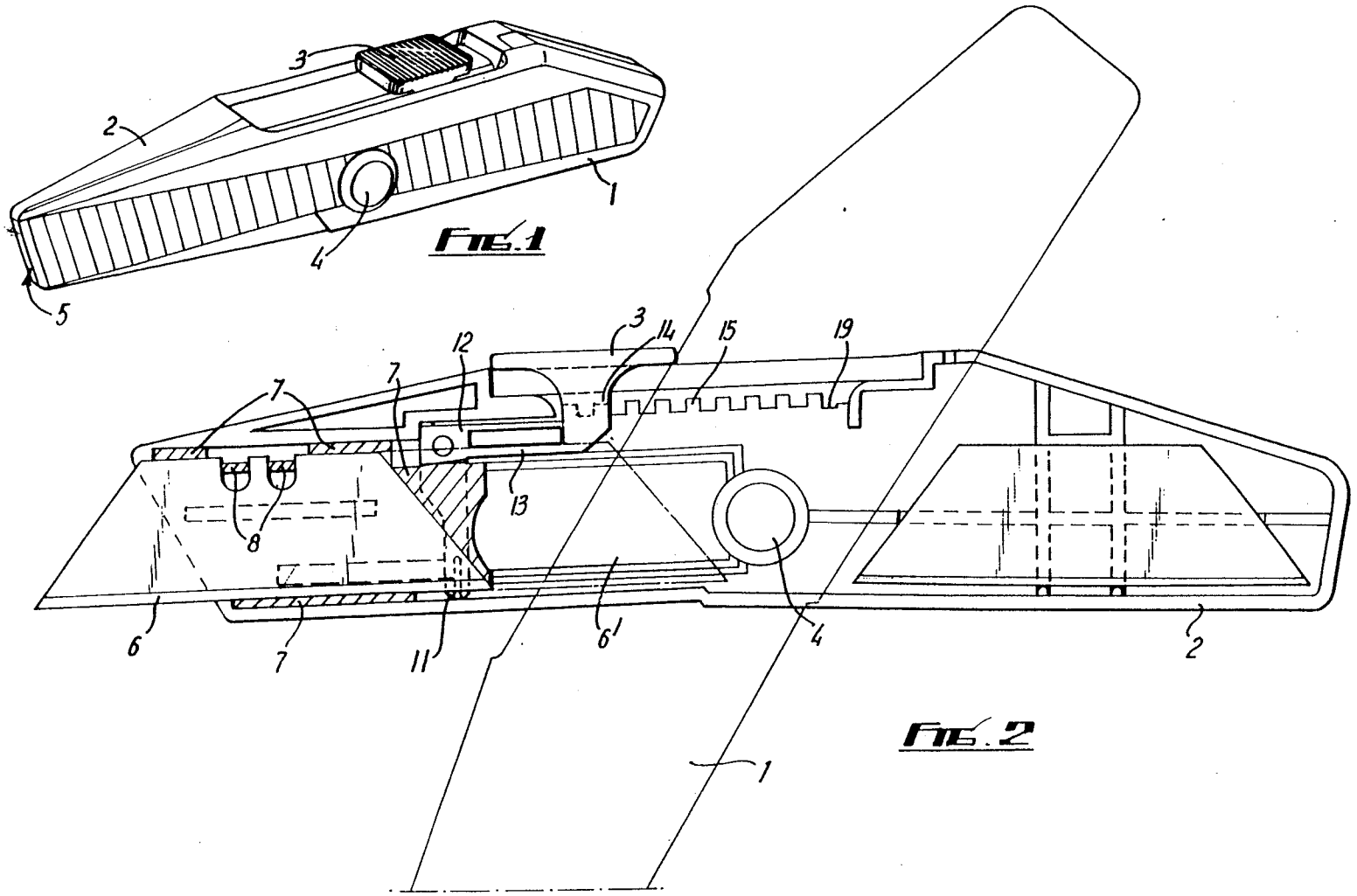
FIG. 1 is a perspective view of a knife in accordance with this invention, the blade being retracted.
FIG. 2 shows the interior of the right hand portion of the knife.
Figure 3:
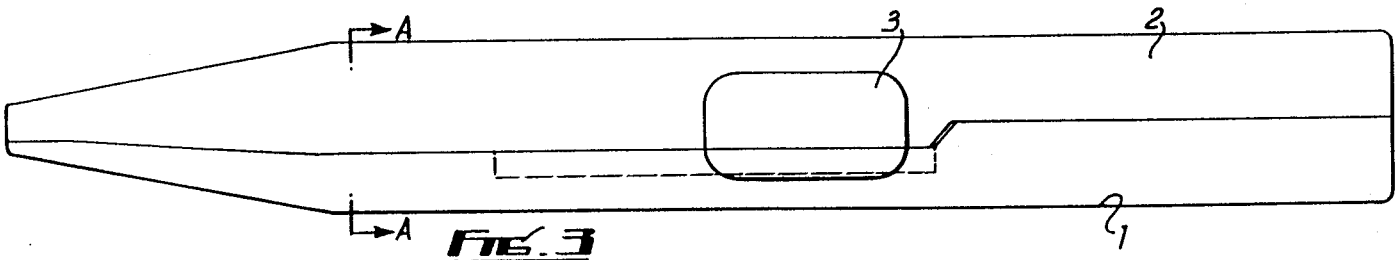
FIG. 3 is a plan view of the knife.
Figure 5:
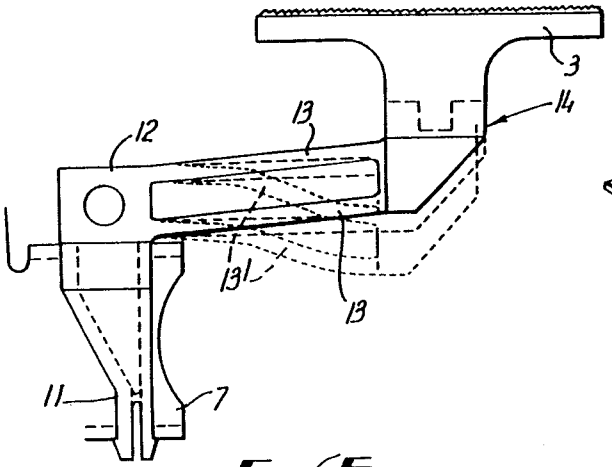
FIG. 5 illustrates the latch member of the knife.

FIG. 1 of the drawings illustrates a knife having a retracted blade located in a slot 5, the handle being formed in two portions 1,2 connected together by a pivot 4 arranged so that the two portions may be rotated in planes generally parallel to that of the blade. Rotation of one of the portions provides access to the interior of the handle, facilitating replacement of the interior of the handle, facilitating replacement of the blade and providing access to a store of replacement blades located within the handle. An actuating member having a plate 3 which may be engaged manually, for example by a user's thumb, is arranged for sliding movement longitudinally of the knife to extend or retract the blade. When the blade is fully retracted such that the blade no longer projects from the handle, the plate 3 may be moved further rearwardly to unlock the two handle portions, for example to replace the blade. The two portions are securely locked together when the blade is extended, preventing the blade from moving within the handle when in use.

Figure 6:
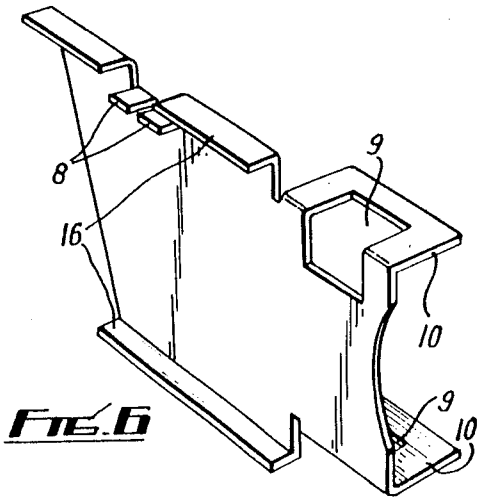
FIG. 6 is a perspective view of the blade carrier of the knife.

The internal construction of the knife is illustrated in FIG. 2. The blade 6, mounted on a carrier 7, is movable between an extended position 6 and a retracted position 6'. The carrier 7, illustrated in FIG. 6, comprises a channel shaped structure arranged to receive a blade. Two or more lugs 8 are arranged to engage location notches on the back of the blade 6. The rear of the carrier 7 has a socket 9 formed in two flanges 10 on the side of the carrier facing away from the blade receiving channel. The carrier is disposed in a guideway formed by the two handle portions and is able to slide forward and backward in the guideway. A snap fitting arm 11 of the actuating member 12 is engaged within the socket 9. The plate 3 of the actuating member 12 is connected to the arm 11 by a deformable linkage 13 composed of two generally parallel flexible members. In the non-deflected position, when no pressure is applied to the plate 3, a stepped portion 14 engages one of a plurality of teeth 15 extending longitudinally of the body portion 2, thereby locking the blade in any of a variety of extended, partially extended or retracted locations. Depression of the plate 3 causes the member 13 to be deflected to the location 13'. Use of the two members 13, instead of a hinge, increases the working life of the knife by reducing flexural stress on the actuating member. Friction is avoided. Moreover a spring-return action is provided.

Figure 4:
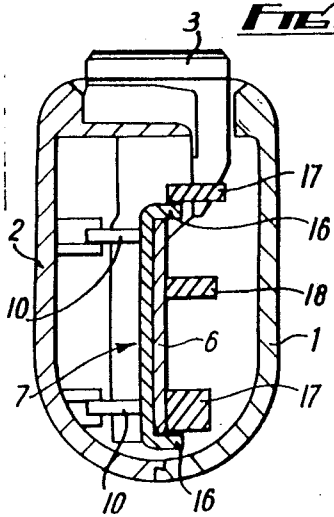
FIG. 4 is a cross section on A—A of FIG. 3

Locking of the two handle portions together is achieved by engagement of flanges on the blade carrier with projections on the inner surface of the handle portion 1. This is illustrated in FIG. 4 wherein the blade retaining flanges 16 engage projections 17 of the handle portion 1. A further projection 18 bears against the blade 6 holding the latter in position. Rearward motion of the carrier 7 does not disengage the flanges from the handle portion 1 until the plate 3 is moved to its rearmost extent wherein the stepped portion 14 engages the stepped projection 19, the plate having to be additionally depressed beyond the extent normal to disengage the projections 15 to allow this motion. The carrier 7 and blade 6 are then free to pivot relative to the handle portion 1, for example to facilitate replacement of the blade. The need for a separate locking member to hold the handle portions together is thus avoided. Moreover, the handle portions are securely locked adjacent the blade, this being the point of maximum strain in use of the knife. Few components are required in manufacture of the knife.

Many alternative constructions may be employed. Ratchet or alternatively shaped stepped arrangements 14, 15 may be used. Moreover the projections 17 which may have various shapes may engage alternative formations on the blade carrier. The hinge 13 may be alternatively constructed, for example by use of a pivot.

I claim:

1. A knife comprises a handle formed in two handle portions, said handle portions being connected together by a pivot and being pivotally movable between an open position and a closed position, the handle portions in said closed position defining a housing, a retractable blade mounted on a blade carrier, the carrier being movable between a first position wherein the blade projects from the housing and a second position wherein the blade is retracted into the housing such that the blade is not substantially capable of further rearward movement characterised in that the two handle portions are locked in the closed position when the carrier is in the first position and are unlocked when the carrier is in the second position.

2. A knife as claimed in claim 1, characterised in that the carrier is moved by an actuating member.

3. A knife as claimed in claim 2, characterised in that the carrier is movable to one or more intermediate positions wherein the blade is wholly or partially enclosed by the housing and wherein the handle parts remain locked together while said carrier is in an intermediate position.

4. A knife as claimed in claim 3, characterised in that the actuating member is movable between a first position wherein movement of the carrier between its first position and an intermediate position is restrained and a second position wherein movement of the carrier between its first and intermediate position is possible.

5. A knife as claimed in claim 4, characterised in that the actuating member is movable into a third position to permit movement of the carrier between its intermediate and second positions.

6. A knife as claimed in claim 4 characterised in that means are provided for urging the actuating means into its first position.

7. A knife as claimed in claim 5 characterised in that means are provided for urging the actuating means into its first position.

* * * * *